United States Patent [19]

Mode

[11] 4,260,099

[45] Apr. 7, 1981

[54] EXPANDABLE PAPERBOARD CUP AND BLANK THEREFOR

[75] Inventor: Duane Mode, Minneapolis, Minn.

[73] Assignee: Champion International Corporation, Stamford, Conn.

[21] Appl. No.: 91,822

[22] Filed: Nov. 6, 1979

[51] Int. Cl.[3] ..... B65D 5/24; B65D 5/22

[52] U.S. Cl. ..... 229/31 R; 426/115; 229/8; 229/DIG. 3

[58] Field of Search ..... 229/8, 31, 33, 40; 426/115

[56] References Cited

U.S. PATENT DOCUMENTS

| | | | |
|---|---|---|---|
| 2,689,183 | 9/1954 | Colt | 426/115 |
| 3,021,045 | 2/1962 | Morris | 229/8 X |
| 3,251,532 | 5/1966 | Hechtman et al. | 229/DIG. 3 |
| 3,533,807 | 10/1913 | Wakefield | 426/115 X |
| 3,598,303 | 8/1971 | Folz | 229/DIG. 3 |
| 4,036,423 | 7/1977 | Gordon | 229/31 R |
| 4,068,795 | 1/1978 | Forster | 229/31 R |
| 4,088,261 | 5/1978 | Osborne | 229/31 R |

*Primary Examiner*—Davis T. Moorhead
*Attorney, Agent, or Firm*—Evelyn M. Sommer

[57] ABSTRACT

An expandable container in the form of a cup made from a unitary blank of paperboard. The container has a bottom panel and four side panels and the paperboard is coated so the container can receive a liquid, such as soup, therein. A sidewise pressure exerted on the side panels downwardly expands the bottom panel to increase the depth of the container for the reception of the liquid. In one embodiment, the bottom panel has a plurality of curvilinear fold lines to allow the downward expansion. In a second embodiment, the bottom panel has a plurality of straight fold lines for this purpose.

20 Claims, 14 Drawing Figures

EXPANDABLE PAPERBOARD CUP AND BLANK THEREFOR

FIELD OF THE INVENTION

The present invention relates to a cup, formed of a unitary paperboard blank, which is expandable downwardly to receive a liquid, such as soup, therein. The cup has a bottom panel and four side panels. A plurality of fold lines in the bottom panel allows the downward expansion upon exertion of a sidewise pressure on the side panels.

BACKGROUND OF THE INVENTION

It has recently become popular for various food manufacturers to produce small packets of dried soup in "instant" form. When added to hot water, these packets of dried soup are reconstituted. These packets usually contain enough dried soup to provide a cup of soup when that amount of water is added. Typically, the container used for the soup will be a ceramic or plastic cup which happens to be available. Of course, after the soup is consumed in the ceramic cup, the cup itself must be washed for subsequent use. And use of many of the plastic type cups is somewhat expensive.

Thus, there is a need for cheap, disposable packaging which will contain the dried soup and also provide a container for the consumption of the soup after hot water is supplied.

SUMMARY OF THE INVENTION

Accordingly, a primary object of the present invention is to provide a cheap, disposable container for dried food materials, such as soup, which can carry the dried soup therein and readily receive a hot liquid to reconstitute the soup.

Another object is to provide such a container which is formed from a unitary coated paperboard blank.

Another object is to provide such a container which is easily expandable downwardly by means of a sidewise pressure exerted on the container.

The foregoing objects are basically attained by providing a unitary paperboard blank adapted to form a container comprising a rectangular main panel having first, second, third and fourth corners; first, second, third and fourth side panels hingedly coupled, respectively, to a side of the main panel along first, second, third and fourth fold lines; a first corner panel hingedly coupled along two fold lines to an end of the first side panel and an end of the second side panel; a second corner panel hingedly coupled along two fold lines to another end of the second side panel and an end of the third side panel; a third corner panel hingedly coupled along two fold lines to another end of the third side panel and a end of the fourth side panel; a fourth corner panel hingedly coupled along two fold lines to another end of the fourth side panel and another end of the first side panel; each of the corner panels having a diagonal fold line therein intersecting one of the corners of the main panel and extending inwardly into the main panel; and the main panel having four inner fold lines, each interconnecting two adjacent diagonal fold lines.

In addition, the foregoing objects are generally attained by providing an expandable container formed from a unitary blank of paperboard and adapted to hold a liquid therein comprising a rectangular bottom panel having four corners; first, second, third and fourth side panels hingedly coupled to the sides of the main panel along fold lines and oriented perpendicularly thereto; means for interconnecting adjacent pairs of the side panels; and means, comprising interconnected fold lines formed in the main panel, for expanding the main panel downwardly in response to inward pressure exerted perpendicularly to the side panels.

Other objects, advantages and salient features of the present invention will become apparent from the following detailed description which, taken in conjunction with the annexed drawings, discloses preferred embodiments of the present invention.

DRAWINGS

Referring now to the drawings which form a part of this original disclosure:

DETAILED DESCRIPTION OF THE INVENTION

Figure 1:
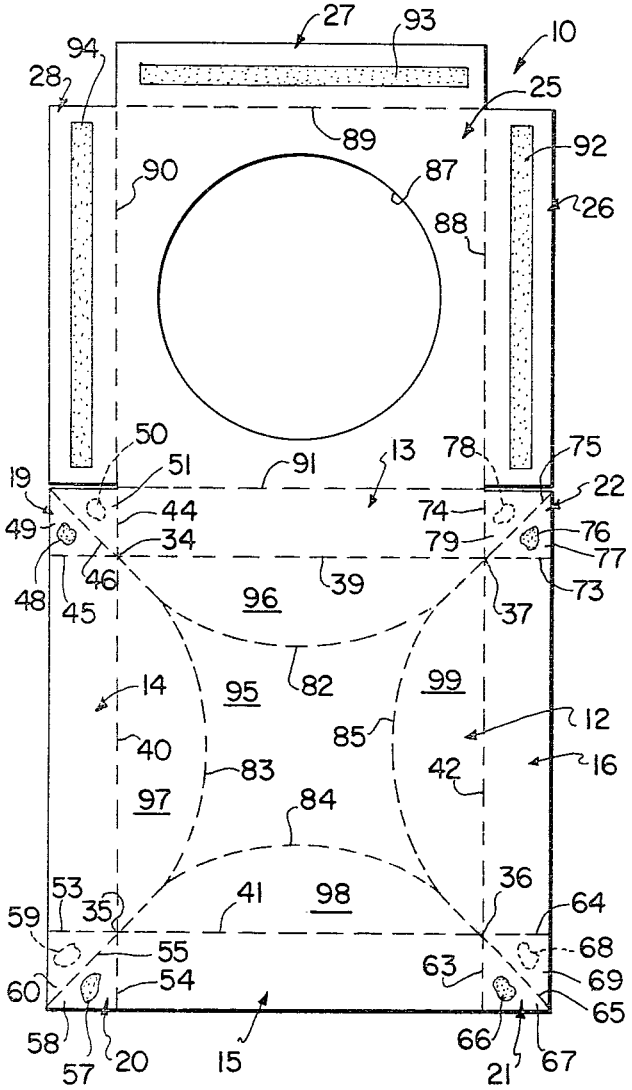
FIG. 1 is a top plan view of the blank in accordance with the present invention showing the inside surface thereof.

Referring now to FIGS. 1–8, the blank 10 in accordance with the present invention is formed from thin, foldable paperboard which is advantageously coated to receive hot liquids. Thus, the blank can be formed of polyethylene or polyethylene terephthalate coated milk carton board, polyester copolymer coated board such as PETG Eastman No. 6763 resin coated board, or 13–15 point clay coated board which has been for example extrusion coated with the resin on one or two sides.

The blank 10 comprises a main, or bottom panel 12, four side panels 13, 14, 15 and 16, four corner panels or webs 19, 20, 21 and 22, a second main, or cover, panel 25, and three side flaps 26, 27 and 28.

The main panel 12 is rectangular, and preferably square, having four corners including a first corner 34, a second corner 35, a third corner 36 and a fourth corner 37.

Each of the side panels 13–16 is rectangular, is hingedly coupled along respective fold lines 39–42 on the four sides of the main panel 12 and has a longitudinal length equal to the length of the main panel sides.

The first corner panel 19 is hingedly coupled respectively along two fold lines 44 and 45 to an end of the first side panel 13 and an end of the second side panel 14. The first corner panel 19 is preferably square and has a diagonal fold line 46 extending from its remote corner to the first corner 34 in the main panel 12 and inwardly into the main panel. As seen in FIG. 1, a spot of adhesive 48 is located on the interior surface of the first corner panel 19 in the triangular area 49 and a second spot of adhesive 50 is located on the second triangular area 51 of the first corner panel 19 except on the outer surface of the blank 10. The diagonal fold line separates the corner panel into these triangular areas.

The second corner panel 20 is hingedly coupled respectively along two fold lines 53 and 54 to another end of the second side panel 14 and an end of the third side panel 15. The second corner panel 20 also is preferably square and has a diagonal fold line 55 extending from a remote corner thereof through the second corner 35 of the main panel 12 and inwardly onto the main panel. A spot of adhesive 57 is located on triangular area 58 of the second corner panel 20 on the interior surface and a second spot of adhesive 59 is formed on the second triangular are a 60 on the exterior surface thereof.

Similarly, the third corner panel 21 is hingedly coupled along respectively two fold lines 63 and 64 to another end of the third side panel 15 and an end of the fourth side panel 16 with a diagonal fold line 65 extending from the remote corner thereof through the third corner 36 of the main parallel12 and extending inwardly into the main panel. A spot of adhesive 66 is located on triangular area 67 in the third corner panel on the interior surface thereof and another spot of adhesive 68 is located on the exterior surface of another triangular area 69 in the third corner panel.

The fourth corner panel 22 similarly is hingedly coupled respectively along two fold lines 73 and 74 to another end of the fourth side panel 16 and another end of the first side panel 13, there being a diagonal fold line 75 extending from the remote corner of the fourth corner panel 22 through the fourth corner 37 in the main panel 12 and extending inwardly into the main panel. A spot of adhesive 76 is located on the interior surface of the fourth corner panel 22 in triangular area 77 and a second spot of adhesive 78 is located on the exterior surface of the fourth corner panel in another triangular area 79.

As seen in FIG. 1, the main panel 12 has four curvilinear, inner fold lines 82, 83, 84 and 85 as arcs of a circle, each including about 70°. Each of the inner fold lines interconnects two adjacent diagonal fold lines in those areas in which they extend inwardly into the main panel. Thus, the first inner fold line 82 interconnects diagonal fold lins 75 and 46, the second inner fold line 83 interconnects diagonal fold lines 46 and 55, the third inner fold line 84 interconnects diagonal fold lines 55 and 65, and the fourth inner fold line 85 interconnects diagonal fold lines 65 and 75. Each of the diagonal fold lines acts as an extension of the respective two interconnecting inner fold lines associated therewith, thereby extending each into the corners of the main panel.

The second main, or cover, panel 25 is rectangular, and preferably square, having the same area as the area enclosed by the main or bottom panel 12. A central, circular aperture 87 is located in the second main panel 25. The three rectangular side flaps 26–28 are each hingedly coupled along respective fold lines 88, 89 and 90 to three sides of the second main panel 25. At the remaining side of the second main panel 25, there is a fold line 91 which hingedly couples the second main panel 25 to the first side panel 13, which is in turn hingedly coupled to the main panel 12. On the interior surfaces of the three side flaps 26–28 are lines of adhesive 92, 93 and 94 for ultimately securing the three side flaps to the second, third and fourth side panels associated with the main panel 12.

Figure 2:
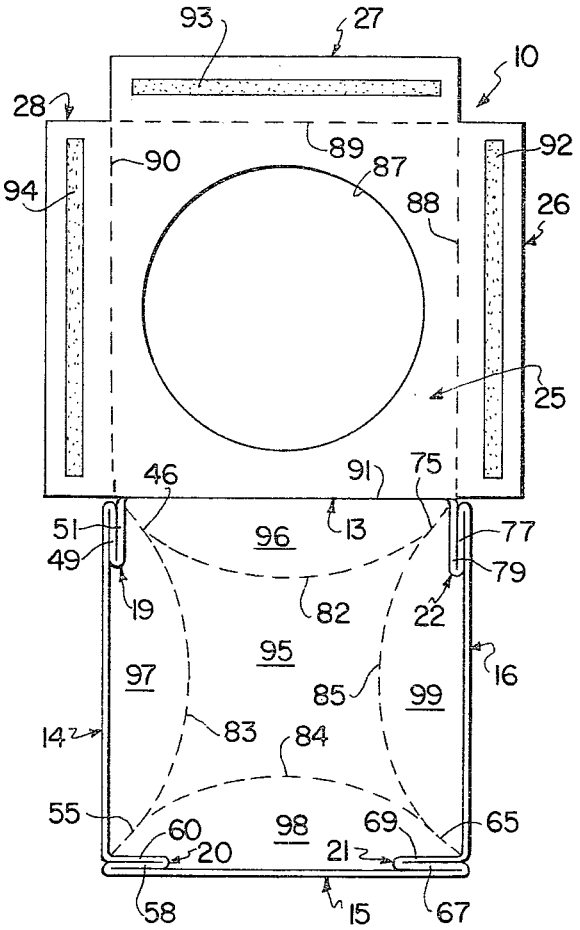
FIG. 2 is a top plan view of the blank shown in FIG. 1 with the side panels oriented perpendicularly to the bottom panel.

As seen in FIGS. 1 and 2, the curvilinear inner fold lines 82–85 enclose in the main panel 12 a diamond-shaped central area 95 and, with the fold lines 19–42, define four peripheral areas 96, 97, 98 and 99 in the main panel 12.

Figure 3:
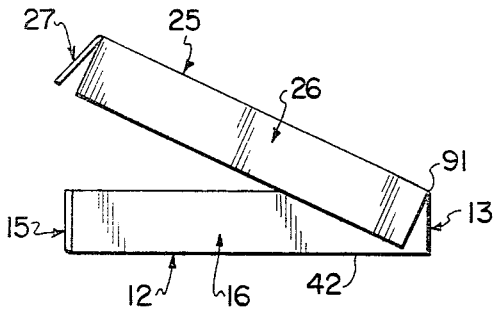
FIG. 3 is a side elevational view of the container shown in FIG. 2 with the cover panel and side flaps having been folded into a position partially overlying the bottom panel.
Figure 4:
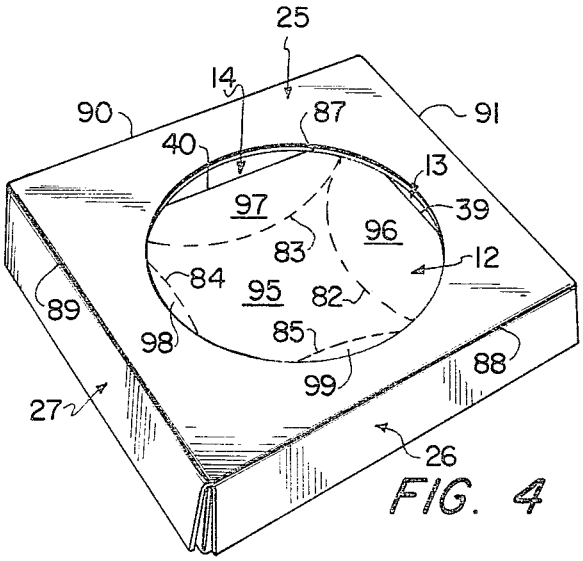
FIG. 4 is a perspective view of the container shown in FIG. 3 except that the cover panel and side flaps have been fully folded and secured to the side panels of the bottom panel.

In constructing the container in accordance with the present invention, the four side panels 13–16 are folded along their respective fold lines 19–42 so that they are oriented perpendicularly to the main panel 12, as seen in FIGS. 2–4. To accomplish this, each of the corner panels is folded along its central diagonal fold line so that these corner panels interconnect each of the two adjacent side panels in the perpendicular position. Thus, as seen in FIG. 2, the first corner panel 19 is folded so that the triangular areas 49 and 51 contact one another and triangular area 49 contacts side panel 14, the adhesive spots 48 and 50 securing these folded areas and panels together. Similarly, the second corner panel 20 is folded such that the triangular area 58 is in contact with triangular area 60 and panel 15 is in contact with triangular area 58, the respective adhesive spots 57 and 59 adhering these panels and areas together. A similar folding and adhering together is provided regarding the third corner panel 21 and its triangular areas 67 and 69 as well as the fourth corner panel 22 and its triangular areas 77 and 79.

Next, the second main or cover panel 25 is folded along fold line 91 into an overlying position with the bottom main panel 12 as seen in FIGS. 3 and 4. In addition, the three side flaps 26–28 are folded along their respective fold lines 88–90 relative to the second main panel 25 so that they are perpendicular thereto. In this configuration, these side flaps are secured via adhesive strips 92–94 to the outside of the second, third and fourth side panels 14–16 associated with the bottom panel 12. This constructed container is shown in FIG. 4.

The contents of the container, which can be dried soup mix, can be located inside the volume defined by the constructed container and the central aperture 87 can be covered by a foil or film closure, which is openable by means of a string or a tape. In all events, when it is desired to introduce a liquid into the interior of the container, the closure of the central aperture 87 is removed and the liquid is poured through the aperture. Preferably, the container is manipulated into an expanded shape before the liquid is introduced therein.

Figure 5:
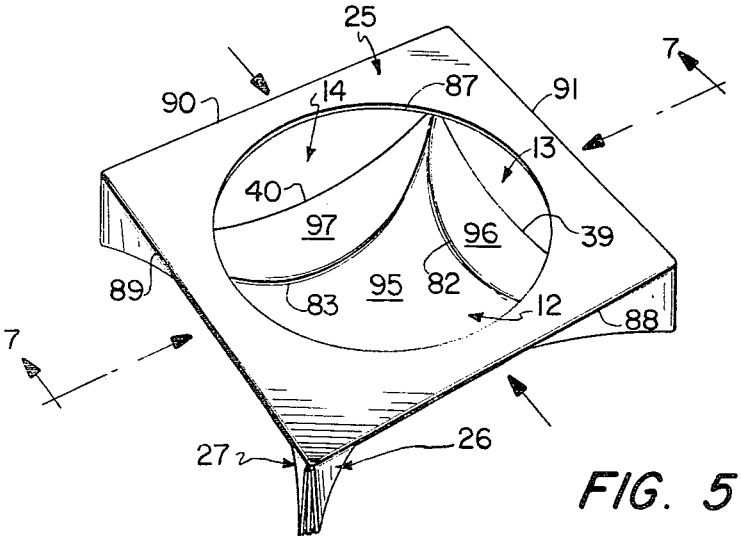
FIG. 5 is a perspective view of the container shown in FIG. 4 except that a sidewise pressure has been exerted on the side panels and side flaps so as to downwardly expand the bottom panel.
Figure 6:
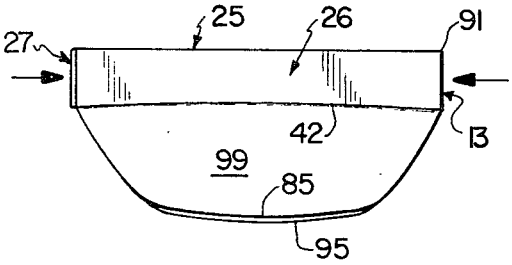
FIG. 6 is a side elevational view of the expanded container seen in FIG. 5.
Figure 8:
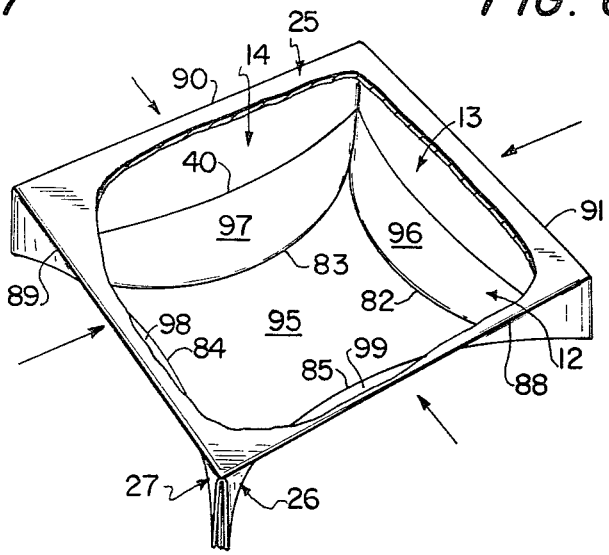
FIG. 8 is a perspective view of the expanded container similar to that seen in FIG. 5 except that portions of the cover panel have been cut away for aid in viewing the expanded bottom panel.

This is accomplished by means of a sidewise pressure being exerted substantially perpendicularly against the side flaps and side panels as represented by the four large arrows seen in FIGS. 5 and 6.

Figure 7:
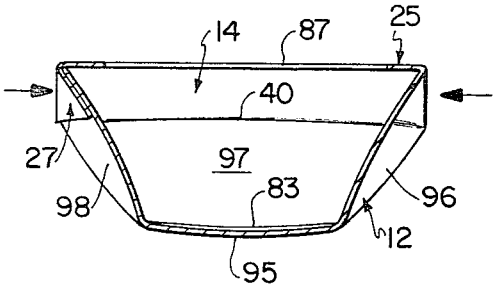
FIG. 7 is a side elevational view in section taken along lines 7—7 in FIG. 5.

Thus, as seen therein, upon a sidewise pressure being exerted against these flaps and panels the main or bottom panel 12 is downwardly expanded as the pressure exerted perpendicularly to the side panels is converted into an inwardly and downwardly bending of the peripheral areas 96–99 and a downwardly expanding movement of the central area 95. This is seen in FIGS. 6 and 7 in which the central area 95 has a concave configuration as seen from above and the peripheral areas 96–99 have a convex configuration as seen from above. In all events, the main panel 12 is downwardly expanded increasing the depth of the container for the reception of a liquid therein.

Referring now to FIGS. 9–12, a second embodiment of the present invention is shown which is similar to that shown in FIGS. 1–8 except that there is no integral cover panel and the interconnected fold lines for providing the downward expansion of the main panel are a series of straight fold lines rather than the curvilinear fold lines described above. To enclose a dried food stuff in the constructed container of this embodiment, a foil or film can be adhered to the side panels spanning the volume defined by these side panels and the bottom panel.

Figure 9:
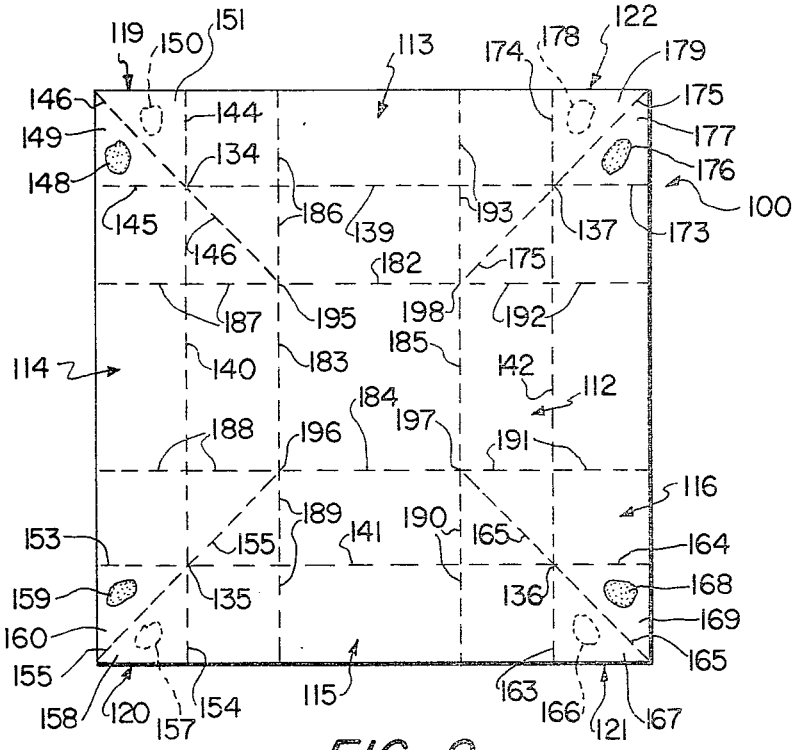
FIG. 9 is a modified blank in accordance with the present invention in top plan view showing the inside surface of the blank.

Referring now to FIG. 9, the modified blank 100 in accordance with the present invention is shown having many of the same fold lines and panels as the blank 10 seen in FIG. 1 with the addition of certain straight fold lines and the deletion of the inner curvilinear fold lines.

The main, or bottom panel, 112 is rectangular and has four corners 134, 135, 136 and 137 defined by the intersection of the four fold lines 139, 140, 141 and 142 along which the four side panels 113, 114, 115 and 116 are hingedly coupled to the sides of the main panel 112. These side panels are rectangular and the main panel is preferably square.

Adjacent each of the four corners 134–137 of the main panel 112 are four corner panels comprising a first corner panel 119, a second corner panel 120, a third corner panel 121 and a fourth corner panel 122. Each corner panel is preferably square and has a diagonal fold line therein intersecting one of the corners of the main panel and extending inwardly into the main panel. Thus, the first corner panel 119 has a diagonal fold line 146, the second corner panel 120 has a diagonal fold line 155, the third corner panel 121 has a diagonal fold line 165 and the fourth corner panel 122 has a diagonal fold line 175.

The first corner panel 119 is hingedly coupled respectively along two fold lines 144 and 145 to an end of the first side panel 113 and an end of the second side panel 114.

The second corner panel 120 is hingedly coupled respectively along two fold lines 153 and 154 to another end of the second side panel 114 and an end of the third side panel 115.

The third corner panel 121 is hingedly coupled respectively along two fold lines 163 and 164 to another end of the third side panel 115 and an end of the fourth side panel 116.

The fourth corner panel 122 is hingedly coupled respectively along two fold lines 173 and 174 to another end of the fourth side panel 116 and another end of the first side panel 113.

The first corner panel 119 is divided by the diagonal fold line 146 into two triangular areas 149 and 150, area 148 having an adhesive spot 148 on the interior surface thereof and area 151 having an adhesive spot 150 on the exterior surface thereof.

The second corner panel 120 is divided by its diagonal fold line 155 into a first triangular area 158 and a second triangular area 160, area 158 having an adhesive spot 157 on the exterior surface thereof and area 160 having an adhesive spot 159 on the interior surface thereof.

The third corner panel 131 is divided by its diagonal fold line 165 into a first triangular area 167 and a second triangular area 169, with triangular area 167 having an adhesive spot 166 on the exterior surface thereof and area 169 having an adhesive spot 168 on the interior surface thereof.

The fourth corner panel 122 is divided by its diagonal fold line 175 into a first triangular area 177 and a second triangular area 179, the first area 177 having an adhesive spot 176 on the interior surface thereof and the second area 179 having an adhesive spot 178 on the exterior surface thereof.

Figure 10:
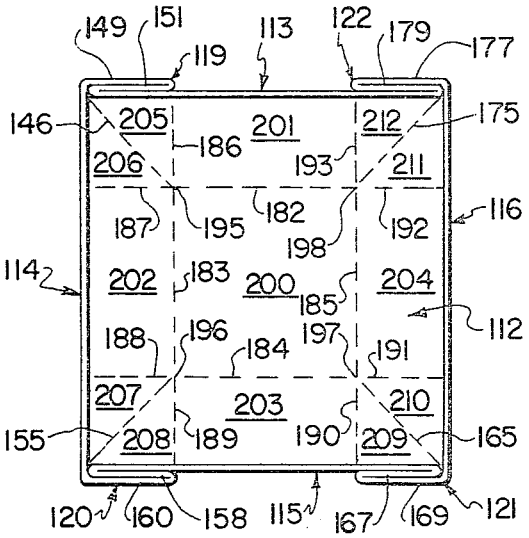
FIG. 10 is a top plan view of the blank seen in FIG. 9 in which the side panels have been oriented perpendicularly to the bottom panel.
Figure 11:
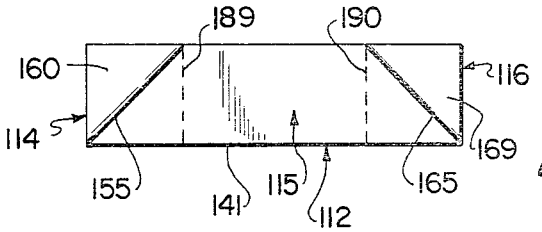
FIG. 11 is a front elevational view of the formed container seen in FIG. 10.

As seen in FIGS. 9 and 10, there are four inner, straight fold lines 182, 183, 184 and 185 located in the main panel 112. The first inner fold line 182 interconnects the diagonal fold line 146 from the first corner panel 119 and the diagonal fold line 175 from the fourth corner panel 122. The second inner fold line 183 interconnects the diagonal fold line 146 from the first corner panel 119 and the diagonal fold line 155 from the second corner panel 120. The third inner fold line 184 interconnects the diagonal fold line 155 from the second corner panel 120 and the diagonal fold line 165 from the third corner panel 121. The fourth inner fold line 185 interconnects the diagonal fold line 165 from the third corner panel 121 and the diagonal fold line 175 from the fourth corner panel 122.

As seen in FIGS. 9 and 10, blank 100 has four pairs of interior straight fold lines, including a first pair 186 and 187, a second pair 188 and 189, a third pair 190 and 191, and a fourth pair 192 and 193, each pair extending from one of the diagonal fold lines outwardly to the outer edges of the two side panels adjacent to that diagonal fold line.

Thus, the first pair of interior lines 186 and 187 extend from diagonal fold line 146 outwardly to the outer edges of the two side panels 113 and 114, respectively. The second pair of interior fold lines 188 and 189 extend from diagonal fold line 155 outwardly to the outer edges of the two side panels 114 and 115, respectively. The third pair of interior fold lines 190 and 191 extend from diagonal line 165 outwardly to the outer edges of the two side panels 115 and 116, respectively. And, the fourth pair of interior fold lines 192 and 193 extend from diagonal fold line 175 outwardly to the outer edges of the two side panels 116 and 113, respectively.

Thus, as seen in FIG. 9, the combination of fold lines 183, 186 and 189 and the combination of fold lines 185, 190 and 193 comprise a first pair of parallel fold lines extending from the outer edge of the first side panel 113, across the main panel 112 and to the outer edge of the third side panel 115.

Similarly, the combination of the fold lines 182, 187 and 192 and in addition the combination of the fold lines 184, 188 and 191 comprise a second pair of parallel fold lines extending from the outer edge of the second side panel 114, across the main panel 112 and to the outer edge of the fourth side panel 116.

These two pairs of parallel fold lines intersect at four points 195, 196, 197 and 198 on the main panel 112.

As seen in FIGS. 9 and 10, the four diagonal fold lines 146, 155, 165 and 175 associated respectively with the four corner panels each extends through one of the four corners 134, 135, 136 and 137 of the main panel 112 to one of the four points 195–198 on the main panel 112.

As seen in FIG. 10, thirteen specific areas are defined by the various straight fold lines contained in the main panel 112. These areas include a central square area 200 defined by the intersection of the inner straight fold lines 182–185 and four peripheral, rectangular areas 210–204 defined respectively by fold lines 182, 186 and 193 and the first side panel 113; fold lines 183, 187 and 188 and second side panel 114; fold lines 184, 189 and 190 and third side panel 115; and fold lines 185, 191 and 192 and fourth side panel 116. In addition, there are eight triangular corner areas 205–212 in the corners of the main panel 112 as seen in FIG. 10. Each of these triangular corner areas has an associated area adjacent thereto, both of these being in one corner of the main panel 112 adjacent the intersection of two side panels. Each one of these pairs is separated by one of the diagonal fold lines 146, 155, 165 and 175.

In order to form the container from the blank 100 seen in FIG. 9, the four side panels 113–116 are folded along their respective fold lines 139–142 so they are perpendicular to the main or bottom panel 112, the triangular areas 149, 151, 158, 160, 167, 169, 177 and 179 being suitably folded and adhered together with the adhesive spots described above. This position is seen in FIG. 10 in top plan view, in FIG. 11 in front elevational view and in FIG. 12 in perspective view.

Figure 12:
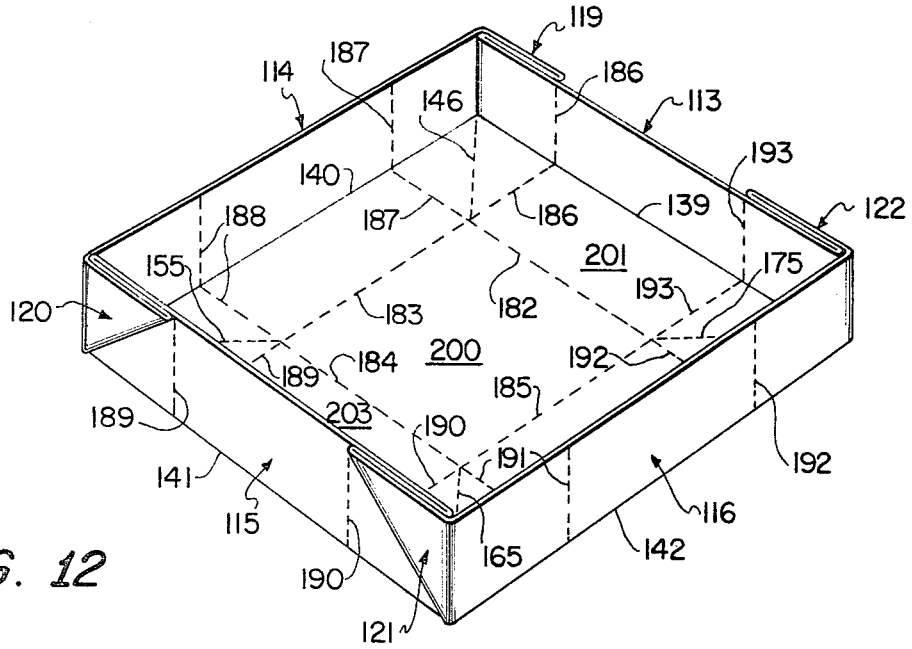
FIG. 12 is a perspective view of the formed container seen in FIG. 10.
Figure 13:
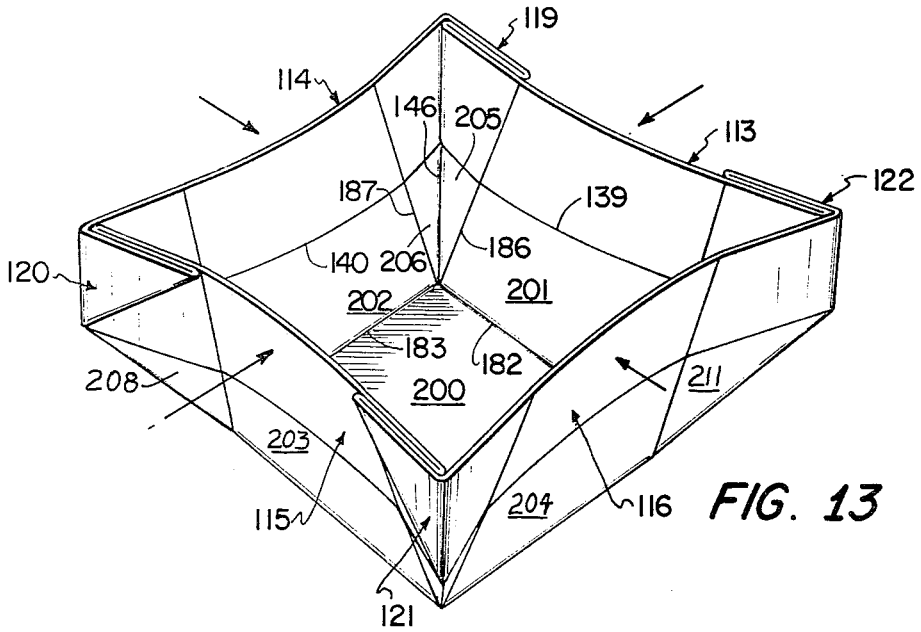
FIG. 13 is a perspective view of the container seen in FIG. 12 except that a sidewise pressure has been exerted on the side panels to downwardly expand the bottom panel of the container.
Figure 14:
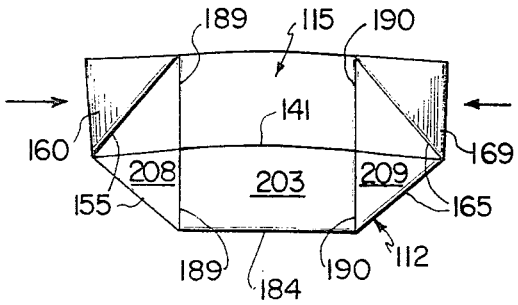
FIG. 14 is a front elevational view of the expanded container seen in FIG. 13.

In order to downwardly expand the main panel 112 of the container seen in FIG. 12, a sidewise pressure is exerted on the side panels 113–116, as represented by the arrows in FIGS. 13 and 14.

This causes an inward movement of these side panels as well as a folding along the four pairs of interior straight lines 186–193. In addition, this causes a folding of the main panel about the four diagonal lines 146, 155, 165 and 175 as well as a folding along the inner fold lines 182, 183, 184 and 185. This results in a downward expansion of the main panel 112 so that the central area 200 is generally below the position in the uncompressed container with the peripheral areas 201–204 assuming a configuration which is upwardly and outwardly expanding as seen in FIG. 13.

In this position, the expanded container can readily receive a hot liquid therein.

While two advantageous embodiments have been chosen to illustrate the invention, it will be understood by those skilled in the art that various changes and modifications can be made therein without departing from the scope of the invention as defined in the appended claims.

What is claimed is:

1. A unitary paperboard blank adapted to form a container comprising:

a rectangular main panel having first, second, third and fourth corners;

first, second, third and fourth side panels hingedly coupled, respectively, to a side of said main panel along first, second, third and fourth fold lines;

a first corner panel hingedly coupled along two fold lines to an end of said first side panel and an end of said second side panel;

a second corner panel hingedly coupled along two fold lines to another end of said second side panel and an end of said third side panel;

a third corner panel hingedly coupled along two fold lines to another end of said third side panel and an end of said fourth side panel;

a fourth corner panel hingedly coupled along two fold lines to another end of said fourth side panel and another end of said first side panel;

each of said corner panels having a diagonal fold line therein intersecting one of said corners of said main panel and extending inwardly into said main panel; and said main panel having four inner fold lines, each interconnecting two adjacent diagonal fold lines.

2. A blank according to claim 1, wherein said inner fold lines are curvilinear.

3. A blank according to claim 1, wherein said inner fold lines are each arcs of a circle.

4. A blank according to claim 3, wherein said arcs are each about 70°.

5. A blank according to claim 1, wherein said inner fold lines are straight.

6. A blank according to claim 1, wherein each of said corner panels is square.

7. A blank according to claim 5, and further comprising:

four pairs of interior straight fold lines, each pair extending from one of said diagonal fold lines outwardly to the outer edges of the two side panels adjacent to said diagonal fold line.

8. A blank according to claim 1, and further comprising a second main panel hingedly coupled along a fold line to the outer edge of one of said side panels, said second main panel having an aperture therein and having an area substantially equal to the area of said main panel.

9. A blank according to claim 8, wherein said aperture is centrally located in said second main panel.

10. A blank according to claim 8, wherein said second main panel has at least one side flap hingedly coupled along a fold line at the side edge thereof.

11. A blank according to claim 8, wherein said second main panel has three side flaps hingedly coupled along fold lines at the side edges thereof.

12. An expandable container formed from a unitary blank or paperboard and adapted to hold a liquid therein comprising:

a rectangular bottom panel having four corners;

first, second, third and fourth side panels hingedly coupled to the sides of said main panel along fold lines and oriented perpendicularly thereto;

means for interconnecting adjacent pairs of said side panels; and means, comprising interconnected fold lines formed in said main panel, for expanding said main panel downwardly in response to inward pressure exerted perpendicularly to said side panels.

13. An expandable container according to claim 12, wherein said means for expanding comprises a plurality of curvilinear fold lines, each extending between two adjacent corners of said bottom panel.

14. An expandable container according to claim 12, and further comprising:

a cover panel hingedly coupled to one of said side panels along a fold line and oriented substantially parallel to said bottom panel.

15. An expandable container according to claim 14, wherein said cover panel has a central aperture therein.

16. An expandable container according to claim 14, wherein said cover panel has an area substantially equal to the area of said bottom panel.

17. An expandable container according to claim 14, wherein said cover panel has three side flaps hingedly coupled along fold lines at the side edges thereof, each of said side flaps being secured to one of said side panels of said bottom panel.

18. An expandable container according to claim 12, wherein said means for expanding comprises a plurality of straight fold lines.

19. An expandable container according to claim 18, wherein said plurality of straight fold lines comprises:

a first pair of parallel fold lines extending from the outer edge of said first side panel, across said bottom panel and to the outer edge of said third side panel, a second pair of parallel fold lines extending from the outer edge of said second side panel, across said bottom panel and to the outer edge of said fourth side panel, said two pairs of parallel fold lines intersecting at four points on said bottom panel, and four diagonal fold lines, each extending from one of said four corners of said bottom panel to one of said four points on said bottom panel.

20. An expandable container according to claim 12, wherein said means for interconnecting adjacent pairs of said side panels comprises four corner panels, each hingedly coupled along two fold lines to two adjacent side panels and each having a diagonal fold line therein.

* * * * *